US007461943B1

(12) United States Patent
Ip

(10) Patent No.: US 7,461,943 B1
(45) Date of Patent: Dec. 9, 2008

(54) FIBER OPTIC GARDEN LIGHT

(76) Inventor: Tin Ying Ip, Room 3-4 11/F, 64-76 Larch Street, Taikoktsui, Hong Kong (HK)

( * ) Notice: Subject to any disclaimer, the term of this patent is extended or adjusted under 35 U.S.C. 154(b) by 0 days.

(21) Appl. No.: 11/803,095

(22) Filed: May 14, 2007

(51) Int. Cl.
*F21V 33/00* (2006.01)

(52) U.S. Cl. ..... 362/153; 362/252; 362/554; 362/555

(58) Field of Classification Search ..... 362/153, 362/153.1, 252, 431, 554, 555, 556, 559, 362/565, 576, 577, 581, 582, 806
See application file for complete search history.

(56) References Cited

U.S. PATENT DOCUMENTS 2,642,519 A * 6/1953 Caustin et al. ..... 362/577
5,392,203 A * 2/1995 Harris, Jr. ..... 362/102
6,367,953 B1 * 4/2002 Lee ..... 362/431
6,655,818 B2 * 12/2003 Liu ..... 362/252
6,758,588 B2 * 7/2004 Hsu ..... 362/582
7,073,932 B2 * 7/2006 Wainwright ..... 362/555
2002/0176260 A1 * 11/2002 Liao ..... 362/806

* cited by examiner

*Primary Examiner*—Y My Quach Lee
(74) *Attorney, Agent, or Firm*—Eric Hanscom; Todd Langford

(57) ABSTRACT

This invention relates to garden lights, and more specifically toward garden lights using light emitting diodes to emit light through one or more fiber optic elements that are housed inside of a transparent tube. The fiber optic elements can be of various lengths, providing light that exits the fiber optic elements at different locations along the length of the transparent tube. Further, the light emitting diodes can be of different colors, rendering a pleasing effect of light in intensity, color, and location.

19 Claims, 4 Drawing Sheets

FIBER OPTIC GARDEN LIGHT

CROSS REFERENCE TO RELATED APPLICATIONS

None.

STATEMENT REGARDING FEDERALLY SPONSORED RESEARCH OR DEVELOPMENT

This invention was not federally sponsored.

BACKGROUND OF THE INVENTION

Field of the Invention

This invention relates to garden lights, and more specifically toward garden lights using light emitting diodes to emit light through one or more fiber optic elements that are housed inside of a transparent tube. The fiber optic elements can be of various lengths, providing light that exits the fiber optic elements at different locations along the length of the transparent tube. Further, the light emitting diodes can be of different colors, rendering a pleasing effect of light in intensity, color, and location.

There are many gardens around the world that are meticulously well kept with many varieties of vegetation. People absorb the natural beauty and find comfort in the serene surroundings. Impressively large trees can be right next to small delicate plants. Gardens themselves can be massive in size, taking up many city blocks, or just a few square feet near a person's home. In any circumstance, once the sun goes down, these gardens are often bathed in darkness.

To combat this darkness, people have placed lights in their gardens, which can often have a dramatic effect. High-powered lights can be used to light up large areas and tall trees, and smaller lights can be used for smaller vegetation. However, these lights pale in comparison to the exquisite beauty that hides in the unlit portions of the garden. These high-powered lights shine brightly and indiscriminately that, while illuminating portions of the garden, are not necessarily pleasing to the eye. Further, these high-powered lights consume large amounts of energy, which cannot only be dangerous to those that stumble upon them, but fail to light up the garden in an eco-friendly manner.

Thus there has existed a long-felt need for garden lights that do not overpower the surroundings but rather accentuate and compliment the surrounding vegetation. These lights should add to and not detract from the garden, and produce light in a way that does not consume excess amounts of energy nor pose a danger to those that install or happen across the light.

The current invention provides just such a solution by having garden lights that use light emitting diodes to emit light through one or more fiber optic elements that are housed inside of a transparent tube. The fiber optic elements can be of various lengths, providing light that exits the fiber optic elements at different locations along the length of the transparent tube. Further the light emitting diodes can be of different colors, rendering a pleasing effect of light in intensity, color, and location.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

SUMMARY OF THE INVENTION

The subject invention is a garden light. It uses a low voltage power source that powers one or more light emitting diodes. The low voltage power source can be a power adapter that plugs into a standard power outlet found in homes that transforms the power from high to low voltage. This low voltage power is then transmitted via wires to the light emitting diodes.

The one or more light emitting diodes are connected to each other in a housing element, where the housing protects the connection from outside moisture, dirt, and the like. This housing is secured to a mounting apparatus. The mounting apparatus is designed to be driven into the ground and support the entire garden light in an upright position.

The light emitting diodes, when powered, emit light that travels towards a transparent tube. The transparent tube is secured to the housing, the mounting apparatus, or both, depending on the configuration. One or more fiber optic strands are located inside of the transparent tube. These fiber optic strands transmit light waves with minimal loss of energy. Every fiber optic strand that is located in the transparent tube has an end that is proximate to the light emitting diode. The light that exits the light emitting diodes and enters one of the ends of the fiber optic strand. The light then travels through the fiber optic strand and exits at the opposite end. Since the fiber optic strands can be of different length, the light will be emitted from the transparent tube at different locations along its length.

At the end of the transparent tube there is an end plug, which can be transparent, translucent, or opaque. The end plug is designed to prevent moisture, dirt, or other foreign objects or elements from entering the transparent tube and damaging the garden light.

The transparent tube itself can also be made from a flexible material. This will allow the tube to be transformed into various shapes by the user. For example, the user can have the invention straight one day, and then bend it into a circle the next day. This allows for the transparent tube to be transformed into an almost infinite number of shapes, sizes, and lengths.

Multiple garden lights can be strung together to create a chain of garden lights. One power source can be wired in series or in parallel to power each garden light that is connected. This allows for easy installation of multiple garden lights. It uses only one low voltage power source that can power multiple garden lights.

Each garden light can also have multiple light emitting diodes, each of which can be of a different color. These different colors of light are then transmitted through the fiber optic strands and released at different locations along the length of the transparent tube. This creates a unique and please lighting effect that can greatly increase the visual beauty of the garden at night.

It is a principal object of the invention to provide a garden light that emits light that is pleasing to the eye.

It is another principal object of the invention to provide a garden light that consumes little energy and is safe to install and operate.

It is a further object of the invention to provide a garden light that can be connected to other garden lights forming a chain of garden lights, where each garden light shares the same power source.

It is a final object of this invention to provide a garden light that can be of various shapes, sizes, and lengths, so as to create unique and pleasurable lighting effects.

It should be understood the while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

DETAILED DESCRIPTION OF THE FIGURES

Figure 1:
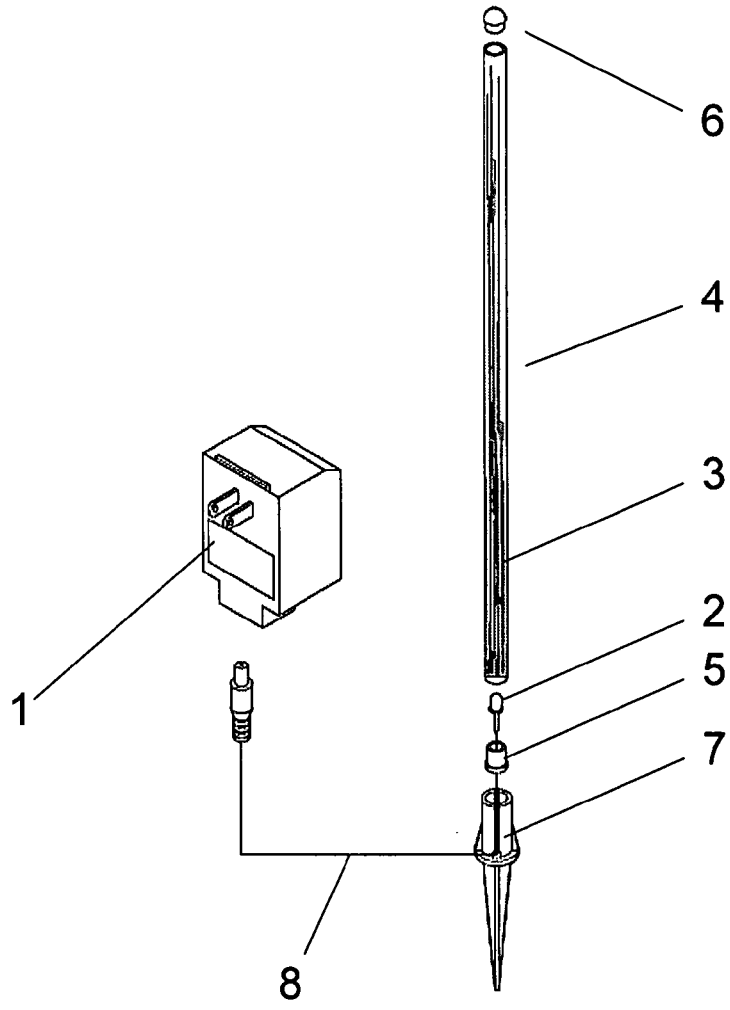
FIG. 1 is a perspective view of the invention, showing individual parts of the invention.

FIG. 1 is a perspective view of the invention, showing the individual parts of the invention. The power supply (I) connects via wires (8) to the light emitting diode (2). The light emitting diode (2) is secured to the housing (5), which in turn is secured to the mounting apparatus (7). The transparent tube (4) is then connected to the housing (5) and mounting apparatus (7) proximately to the light emitting diode (2). Inside of the transparent tube (4) are multiple fiber optic strands (3). At the opposite end of the transparent tube (4) from the light emitting diode (2) is the end plug (6). The bottom portion of the mounting apparatus (7) includes a spike, where the spike can be driven into the ground.

Figure 2:
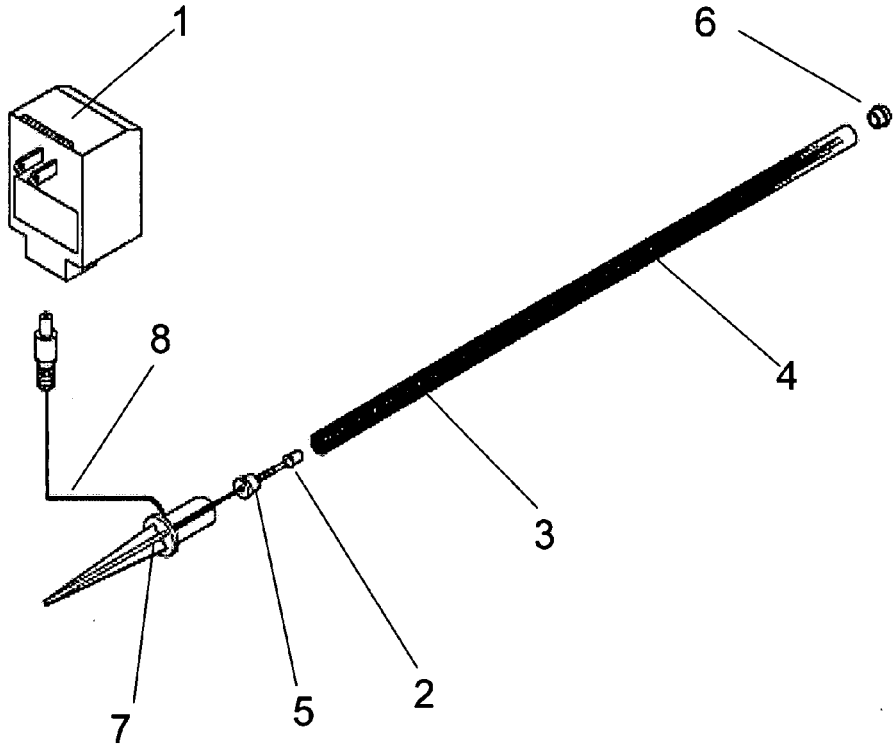
FIG. 2 is a perspective view of the invention, showing the invention assembled.

FIG. 2 is a perspective view of the invention, showing the invention assembled. The power supply (1) connects via the wires (8) to the light emitting diode (not shown in this figure). The transparent tube (4) is then connected to the mounting apparatus (7) proximately to the light emitting diode (not shown in this figure). Inside of the transparent tube (4) are multiple fiber optic strands (3). At the opposite end of the transparent tube (4) from the light emitting diode (not shown in this figure) is the end plug (6).

Figure 3:
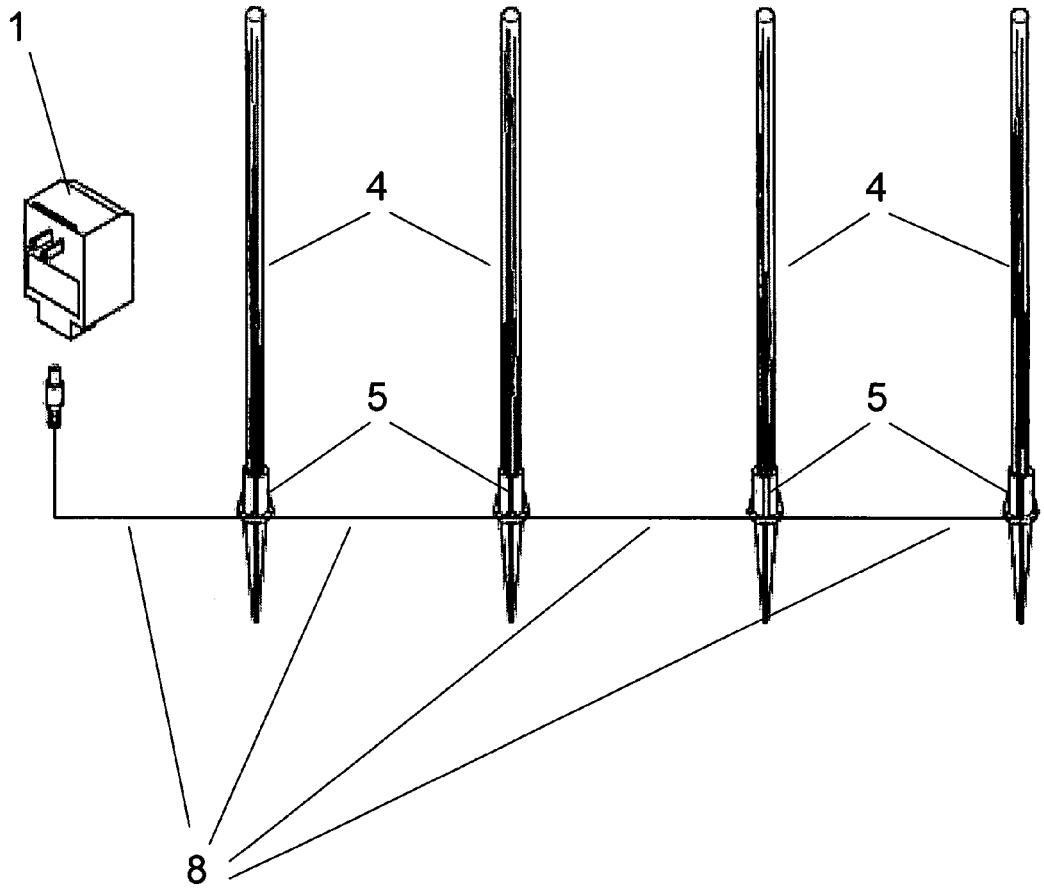
FIG. 3 is a perspective view of multiple garden lights connected together to one power source, where the transparent tube is a straight shaft.

FIG. 3 is a perspective view of multiple garden lights connected together to one power source, where the transparent tube is a straight shaft. The power supply (1) connects via the wires (8) to the multiple garden lights. The wires (8) are fed through the mounting apparatus (5) and connect to the light emitting diode(s) (not shown in this figure). The transparent tube (4) is the in the shape of a straight shaft.

Figure 4:
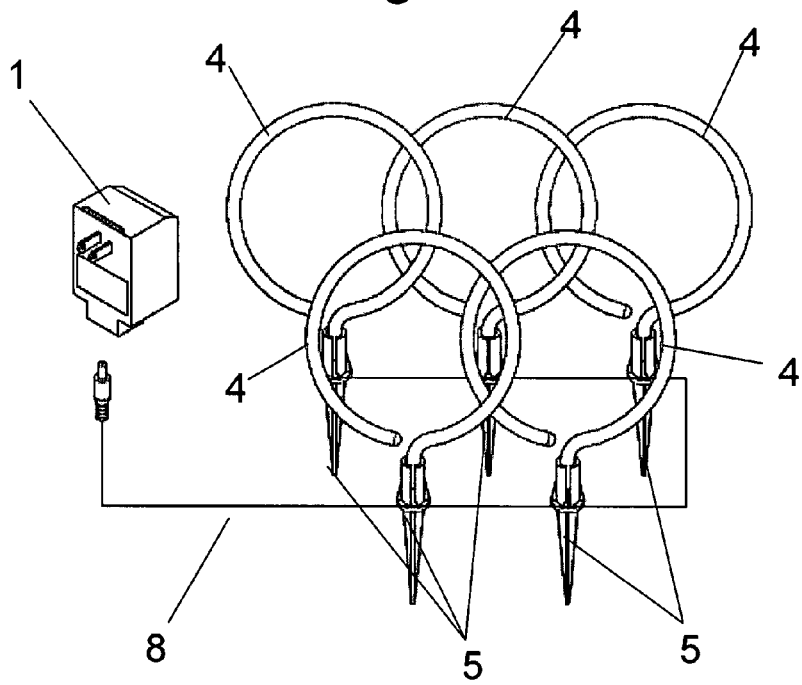
FIG. 4 is a perspective view of multiple garden lights connected together to one power source, where the transparent tube is in the shape of a circle.

FIG. 4 is a perspective view of multiple garden lights connected together to one power source, where the transparent tube is in the shape of a circle. The power supply (1) connects via the wires (8) to the multiple garden lights. The wires (8) are fed through the mounting apparatus (5) and connect to the light emitting diode(s) (not shown in this figure). The transparent tube (4) is in the shape of a circle.

Figure 5:
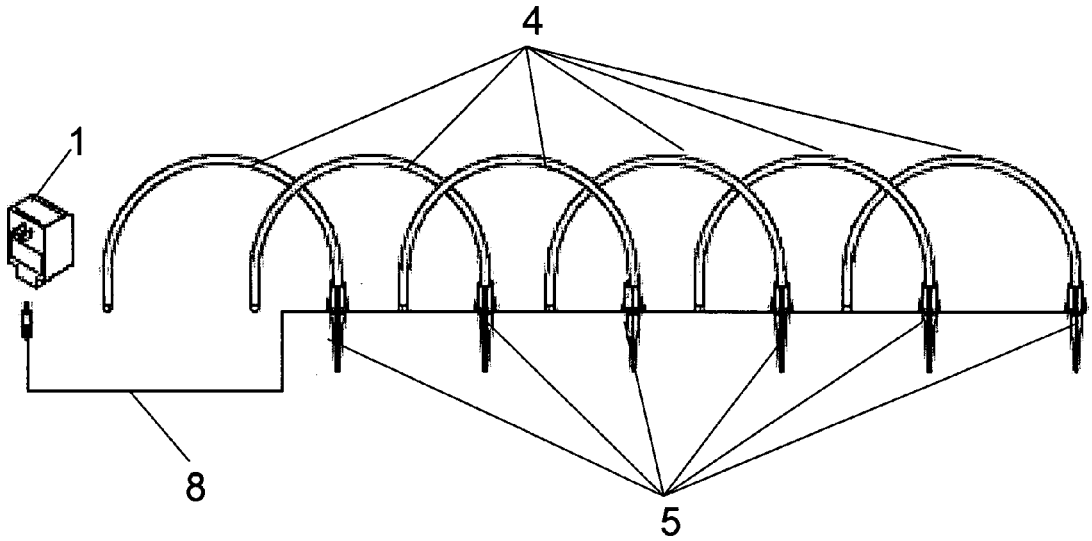
FIG. 5 is a perspective view of multiple garden lights connected together to one power source, where the transparent tube is in the shape of a semi-circle.

FIG. 5 is a perspective view of multiple garden lights connected together to one power source, where the transparent tube is in the shape of a semi-circle. The power supply (1) connects via the wires (8) to the multiple garden lights. The wires (8) are fed through the mounting apparatus (5) and connect to the light emitting diode(s) (not shown in this figure). The transparent tube (4) is in the shape of a semi-circle.

What I claim is:

1. A plurality of garden lights, where each of the garden lights comprises:

one or more light emitting diodes, where the one or more light emitting diodes are connected to a power source by means of wires, and where the power source is a low voltage power source, a housing, where the one or more light emitting diodes are secured to said housing, where the light emitting from the one or more light emitting diodes is allowed to freely exit the housing, and where the wires connected to the one or more light emitting diodes exit the housing in a direction opposite that in which the light emitting from the one or more light emitting diodes exits, and where the housing protects and secures the connection between the wires and the one or more light emitting diodes, a mounting apparatus, where the housing and mounting apparatus are designed to be fitted and secured together, where the mounting apparatus comprises a spike, and where the spike is designed to secure the garden light to to the ground, a transparent tube, where the transparent tube can be of various shapes and sizes, and where the transparent tube is designed to be fitted with and secured to the housing, the mounting apparatus, or both, where the end that is secured to the housing, the mounting apparatus, or both is open so as to allow light from the light emitting diodes to pass into the transparent tube, one or more fiber optic strands, where each fiber optic strand is housed inside of the transparent tube, and one end of each fiber optic strand is proximate to the end of the transparent tube which is secured to the housing, the mounting apparatus, or both so that light from the light emitting diodes that passes into the transparent tube enters the one or more fiber optic strands, an end plug, where the end plug securely fits into the end of the transparent tube which is opposite that of the one or more light emitting diodes, where the end plug prevents moisture from entering the transparent tube, where each of the garden lights is connected to another garden light by means of wires.

2. The garden light of claim 1, where there are two or more fiber optic strands and where each of these strands is of a different length.

3. The garden light of claim 1, where the end plug has to prevent moisture, dirt, or other foreign objects or elements from entering the transparent tube and damaging the garden light.

4. The garden light of claim 1, where there are two or more fiber optic strands, where some of these strands are of the same length while others are of a different length.

5. The garden light of claim 1, where the end plug is comprised of a rubberized substance.

6. The garden light of claim 1, where the housing is comprised of a rubberized substance.

7. The garden light of claim 1, where the shaft of the transparent tube is straight.

8. The garden light of claim 1, where the transparent tube is formed into the shape of a circle.

9. The garden light of claim 1, where the transparent tube is formed into the shape of a semi-circle.

10. The garden light of claim 1, where there are two or more light emitting diodes, and where two or more of the light emitting diodes emit different colors of light.

11. The garden light of claim 1, where there are two or more light emitting diodes, and where two or more of the light emitting diodes emit the same color of light.

12. The garden light of claim 1, where the transparent tube is flexible and can be transformed into different shapes whenever the user desires.

13. The garden light of claim 1, where the end plug is opaque thereby blocking light from escaping the end of the transparent tube.

14. A plurality of garden lights, where each of the garden lights consists of:

one or more light emitting diodes, where the one or more light emitting diodes are connected to a power source by means of wires, and where the power source is a low voltage power source, a housing, where the one or more light emitting diodes are secured to said housing, where the light emitting from the one or more light emitting diodes is allowed to freely exit the housing, and where the wires connected to the one or more light emitting diodes exit the housing in a direction opposite that in which the light emitting from the one or more light emitting diodes exits, and where the housing protects and secures the connection between the wires and the one or more light emitting diodes, a mounting apparatus, where the housing and mounting apparatus are designed to be fitted and secured together, where the mounting apparatus comprises a spike, and where the spike is designed to secure the garden light to to the ground, a transparent tube, where the transparent tube can be of various shapes and sizes, and where the transparent tube is designed to be fitted with and secured to the housing, the mounting apparatus, or both, where the end that is secured to the housing, the mounting apparatus, or both is open so as to allow light from the light emitting diodes to pass into the transparent tube, one or more fiber optic strands, where each fiber optic strand is housed inside of the transparent tube, and one end of each fiber optic strand is proximate to the end of the transparent tube which is secured to the housing, the mounting apparatus, or both so that light from the light emitting diodes that passes into the transparent tube enters the one or more fiber optic strands, an end plug, where the end plug securely fits into the end of the transparent tube which is opposite that of the one or more light emitting diodes, where the end plug prevents moisture from entering the transparent tube, where the end plug has means to prevent moisture, dirt, or other foreign objects or elements from entering the transparent tube and damaging the garden light, and where the transparent tube is made from a flexible material that allows the transparent tube to be bent the transparent tube into various shapes, where each of the garden lights is connected to another garden light by means of wires.

15. The plurality of garden lights of claim 14, where there are two or more fiber optic strands and where each of these strands is of a different length, and, where there are two or more fiber optic strands, where some of these strands are of the same length while others are of a different length.

16. The plurality of garden lights of claim 15, where the end plug is comprised of a rubberized substance, and, where the housing is comprised of a rubberized substance, and, where the garden light is connected by means of wires to one or more additional garden lights to form a strand of garden lights, all of which are powered by the same power source.

17. The plurality of garden lights of claim 16, where the transparent tube is formed into a shape, where the shape is selected from the group consisting of a straight line, a circle, and a semi-circle.

18. The plurality of garden lights of claim 15, where the transparent tube is flexible and can be transformed into different shapes and, where the end plug is opaque thereby blocking light from escaping the end of the transparent tube, and where there are two or more light emitting diodes, and where two or more of the light emitting diodes emit different colors of light.

19. The plurality of garden lights of claim 15, where the transparent tube is flexible and can be transformed into different shapes and, where the end plug is opaque thereby blocking light from escaping the end of the transparent tube, and where there are two or more light emitting diodes, and where two or more of the light emitting diodes emit the same color of light.

* * * * *